United States Patent [19]

Sweetser et al.

[11] Patent Number: 4,789,019

[45] Date of Patent: Dec. 6, 1988

[54] WIND PROOF TABLE COVERING ADAPTED FOR DIFFERENT SHAPED TABLES

[76] Inventors: Jackie A. Sweetser, 2700 Malvern Rd., 12 Cedar Cir., Hot Springs, Ark. 71901; George Spector, 233 Broadway Rm. 3815, New York, N.Y. 10007

[21] Appl. No.: 50,906

[22] Filed: May 18, 1987

[51] Int. Cl.[4] ..... A47G 11/00

[52] U.S. Cl. ..... 150/52 R; 24/115 R; 24/266; 108/90

[58] Field of Search ..... 150/52 R; 108/90; D6/617, 621; 24/115 R, 122.6, 136 R, 266, 117, 143 R; 383/74, 72

[56] References Cited

U.S. PATENT DOCUMENTS

| | | | |
|---|---|---|---|
| 934,993 | 9/1909 | Brunson | 108/90 |
| 1,142,571 | 6/1915 | Hoffberg | 150/52 R |
| 1,219,790 | 3/1917 | Taylor | 150/52 R |
| 1,326,746 | 12/1919 | Kunath | 150/52 R |
| 1,921,645 | 8/1933 | Williams et al. | 108/90 |
| 2,634,183 | 4/1953 | Derman | 108/90 |
| 3,279,215 | 10/1966 | Kesh | 150/52 R |
| 3,295,577 | 1/1967 | Danielson | 150/52 R |
| 3,782,435 | 1/1974 | Sherman | 150/52 R |

FOREIGN PATENT DOCUMENTS

| | | | |
|---|---|---|---|
| 475771 | 5/1929 | Fed. Rep. of Germany | 150/52 R |
| 3431889 | 3/1986 | Fed. Rep. of Germany | D6/617 |

*Primary Examiner*—Sue A. Weaver

[57] ABSTRACT

A wind proof table cover is provided and consists of a sheet of material that is secured to a table top by a drawstring so that a person will not be bothered by wind blowing the cover when used outdoors. In a modification the cover can be used for both a square and circular table.

2 Claims, 1 Drawing Sheet

WIND PROOF TABLE COVERING ADAPTED FOR DIFFERENT SHAPED TABLES

BACKGROUND OF THE INVENTION

The instant invention relates generally to furniture covers and more specifically it relates to a wind proof table cover.

Numerous furniture covers have been provided in prior art that are adapted to be applied to tops of tables. For example U.S. Pat. Nos. 1,142,571; 1,240,208 and 1,326,746 all are illustrative of such prior art. While these units may be suitable for the particular purpose to which they address, they would not be as suitable for the purposes of the present invention as heretofore described.

SUMMARY OF THE INVENTION

A primary object of the present invention is to provide a wind proof table cover that will overcome the shortcomings of the prior art devices.

Another object is to provide a wind proof table cover in which the cover is secured to a table top so that a person will not be bothered by wind blowing the cover when used outdoors.

An additional object is to provide a wind proof table cover that can be used for both a square and a circular table.

A further object is to provide a wind proof table cover that is simple and easy to use.

A still further object is to provide a wind proof table cover that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
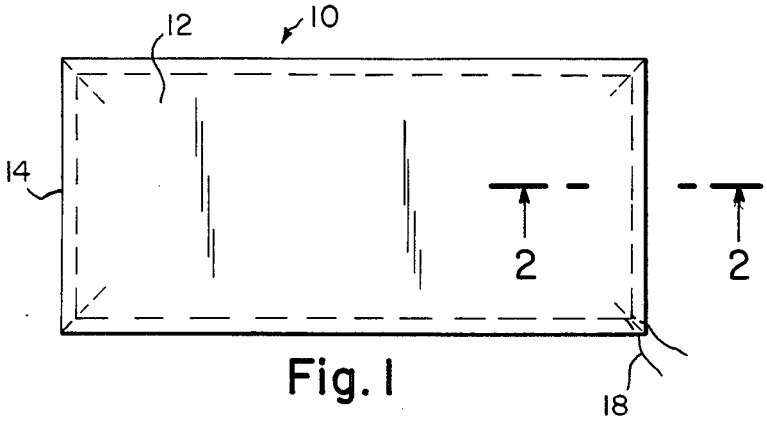
FIG. 1 is a top view of a rectangular table cover.
Figure 2:
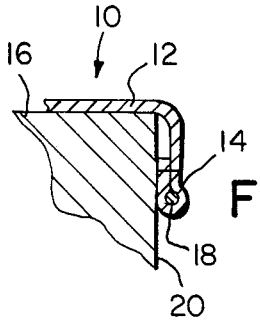
FIG. 2 is a cross sectional view taken along line 2—2 in FIG. 1 showing the tunnel for the pull string in greater detail.
Figure 3:
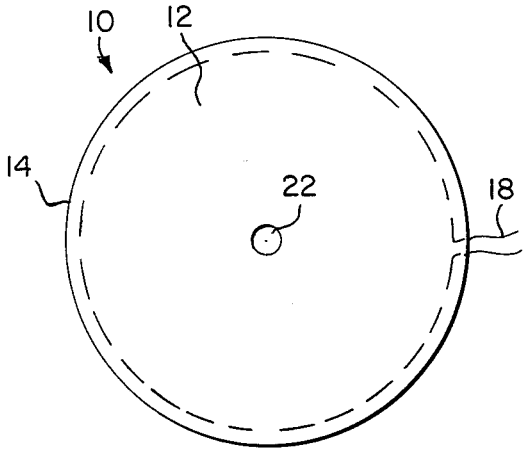
FIG. 3 is a top view of a circular table cover having a removable central opening insert for an umbrella stand.

Turning now descriptively to the drawings, in which similar reference characters denote similar elements throughout the several views, FIGS. 1, 2 and 3 illustrate a windproof table cover 10 consisting of a sheet of material 12 that has a looped flange 14 around perimeter thereof. The sheet 12 is placed upon a table top 16. A draw string 18 is placed through the looped flange 14 for manually pulling the looped flange 14 of the sheet 12 inwardly to grip sides 20 of the table top 16 so that a person will not be bothered by wind blowing the cover 10 off the table top 16 when used outdoors.

FIG. 1 shows the sheet 12 being in a generally rectangular shape so as to be used upon a rectangular table top 16. FIG. 3 shows the sheet 12 being in a generally circular shaped that has a removable central opening insert 22 for an umbrella stand (not shown). The sheet 12 is to be used upon a circular table top 16.

Figure 4:
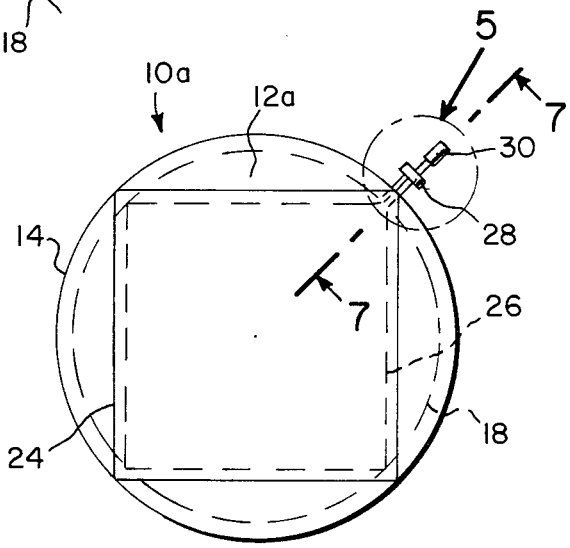
FIG. 4 is a top view of a modification in which the cover can be used for a square and circular table.
Figure 5:
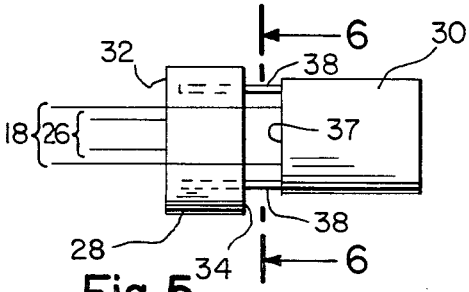
FIG. 5 is an enlarged detail view as indicated by numeral 5 in FIG. 4 showing the pull caps.

FIG. 4 shows a modified wind proof table cover **10*a* containing a sheet 12*a* being in a generally circular shape that has a second inner looped flange 24 in a generally square shape thereof so that the sheet 12*a* can be placed in one instance upon a circular table top 16 and in another instance upon a square table top 16. A second drawstring 26 is placed through the second inner looped flange 24 for manually pulling the second inner looped flange of the sheet 12*a* inwardly to grip sides 20 of the square table top 16**.

As shown in FIGS. 4 through 7 the cover **10*a* further contains a first large diameter cap 28 and a second small diameter cap 30. The inner end 32 of the first cap 28 is affixed to free ends of the second drawstring 26 and outer end 34 of the first cap 28 has a circular groove 36 therein. The inner end 37 of the second cap 30 is affixed to free ends of the first drawstring 18 which slideably extends through openings in the first cap 28. The inner end 37 of the second cap 30 has a pair of spaced apart arms 38 that can enter the circular groove 36 in the first cap 28. When the sheet 12*a* is placed in one instance upon the circular table top 16 and the second cap 30 is manually pulled causing looped flange 14 to grip sides 20 of the circular table top 16. Cap 30 and drawstring 18 is then wrapped around drawstring 26 for retention. When the sheet 12*a* is placed in another instance upon the square table top 16, cap 30 and cap 28 are pulled together causing drawstring 18 to tighten flange 14 and drawstring 26 to tighten flange 24 about the sides of the table. Cap 30 and drawstring 18 can now be looped about drawstring 26** for retention.

Figure 6:
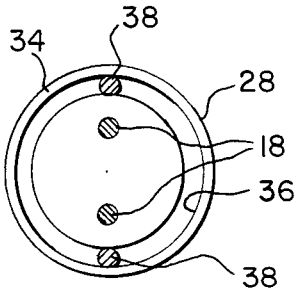
FIG. 6 is a cross sectional view taken along line 6—6 in FIG. 5 showing top of the large pull cap in greater detail.
Figure 7:
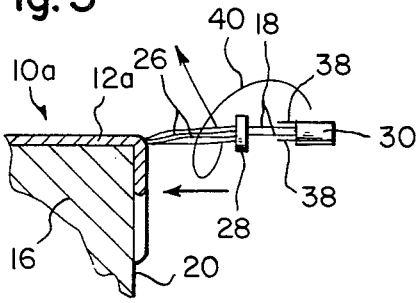
FIG. 7 is a cross sectional view taken along line 7—7 in FIG. 4 showing how the pull caps are secured thereto.

Cap 28 is hollow and has openings in an end wall adjacent groove 36 through which drawstring 18 extend slidably, as indicated in FIG. 6. The drawstrings are affixed to caps 28 and 30 by any conventional means such as adhesive, pins, knots etc. The means of affixation is not the subject of this invention. Drawstring 26 can be affixed to a surface of the walls forming the groove 36. The cap 28 provides a means for separating the drawstring when the drawstrings are not drawn for tightening purposes and also for coupling the caps so that they can be drawn together by pulling on cap 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wind proof table cover which comprises:

(a) a sheet of material having an outer looped flange around a perimeter thereof, and an inner looped flange, said sheet adapted to be mounted upon a table with a peripheral edge;

(b) a first drawstring placed through said outer looped flange for manually pulling the looped flange of said sheet inwardly to grip sides of said table;

(c) a second drawstring mounted in said inner looped flange so that said sheet can be mounted on different tables conforming to one of said looped flanges; and (d) actuating caps each affixed to each of said drawstrings wherein said caps have means for releasably coupling said caps for joint or individual actuation.

2. A wind proof table cover as recited in claim 1, wherein one of said flanges is circular and the other rectangular, said caps comprising:

(e) a first cap with an inner end affixed to free ends of said second drawstring and said means for releasably coupling including a circular groove in an outer end of said first cap; and (f) a second cap with an inner end affixed to free ends of said first drawstring in which said first drawstring slideably extends through said first cap, and said means for releasably coupling also including a pair of spaced apart arms on the inner end of said second cap that can enter the circular groove in said first cap so that said caps can be releasably coupled for joint or separate actuation.

* * * * *